US005308436A

United States Patent [19]

Walter et al.

[11] Patent Number: 5,308,436

[45] Date of Patent: May 3, 1994

[54] REPAIR INSERTER SEALER

[75] Inventors: George E. Walter, Tonawanda; Rebecca L. Parker, Grand Island, both of N.Y.

[73] Assignee: Moore Business Forms, Inc., Grand Island, N.Y.

[21] Appl. No.: 86,834

[22] Filed: Jul. 3, 1993

[51] Int. Cl.[5] ..... B32B 31/00

[52] U.S. Cl. ..... 156/441.5; 156/365; 156/368; 156/442.2; 271/9; 271/226; 271/240; 271/248; 307/328

[58] Field of Search ..... 156/351, 352, 365, 368, 156/441.5, 442.1, 442.2, 217, 227, 555, 556, 580; 271/9, 223, 226, 234, 236, 238, 239, 240, 248, 253, 256, 2, 171; 307/328; 400/642; 493/419, 420, 421

[56] References Cited

U.S. PATENT DOCUMENTS

| | | | |
|---|---|---|---|
| 2,657,051 | 10/1953 | Waechter | 271/248 |
| 3,957,366 | 5/1976 | Taylor et al. | 271/171 X |
| 4,024,942 | 5/1977 | Kawaji | 400/642 X |
| 4,337,935 | 7/1982 | Sawada et al. | 271/9 |
| 4,348,249 | 9/1982 | Denzin | 156/442.2 |
| 4,540,298 | 9/1985 | Kulow | 400/635 |
| 4,580,062 | 4/1986 | MacLoughlin | 307/328 X |
| 4,736,939 | 4/1988 | Smerke et al. | 271/184 |
| 5,049,227 | 9/1991 | Long et al. | 156/442.1 X |
| 5,133,828 | 7/1992 | Jacques | 156/555 |
| 5,183,526 | 2/1993 | Walter | 156/352 X |

*Primary Examiner*—David A. Simmons
*Assistant Examiner*—James J. Engel, Jr.
*Attorney, Agent, or Firm*—Nixon & Vanderhye

[57] ABSTRACT

Business forms may be manually inserted into cooperation with a conveyor between a folder and a sealer by providing an outer movable cover for the conveyor, and an inner normally stationary cover underneath the outer cover. An interlock, formed by a magnet and a reed switch, is provided between the inner cover and the conveyor. A slot is formed in the inner cover, with first and second guide elements extending upwardly and downwardly, respectively, from the slot. Each of the guide elements has a plate, the first guide element having one upstanding guide edge, and the second guide element having adjustably spaced first and second S-shaped guide edges. A planar transition portion of the first guide element overlaps and is connected to the second guide element, and a planar transition portion of the second guide element is connected to the bottom of the inner cover. The second guide element plate makes an angle of between about 30°–60° with respect to the cover plate, and causes inserted forms to pass over some of the rollers of the conveyor directly into association with others.

25 Claims, 4 Drawing Sheets

FIG. 2
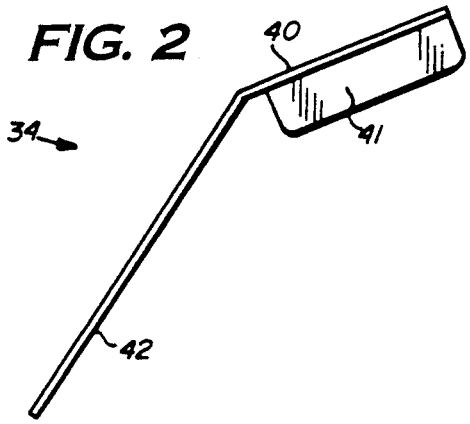
FIG. 3
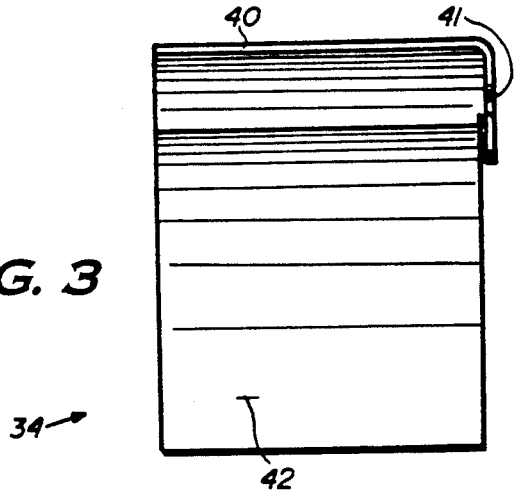
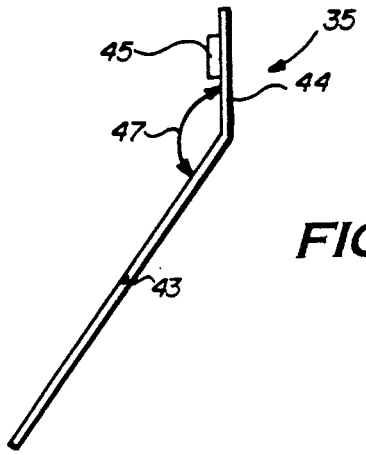
FIG. 4
FIG.5
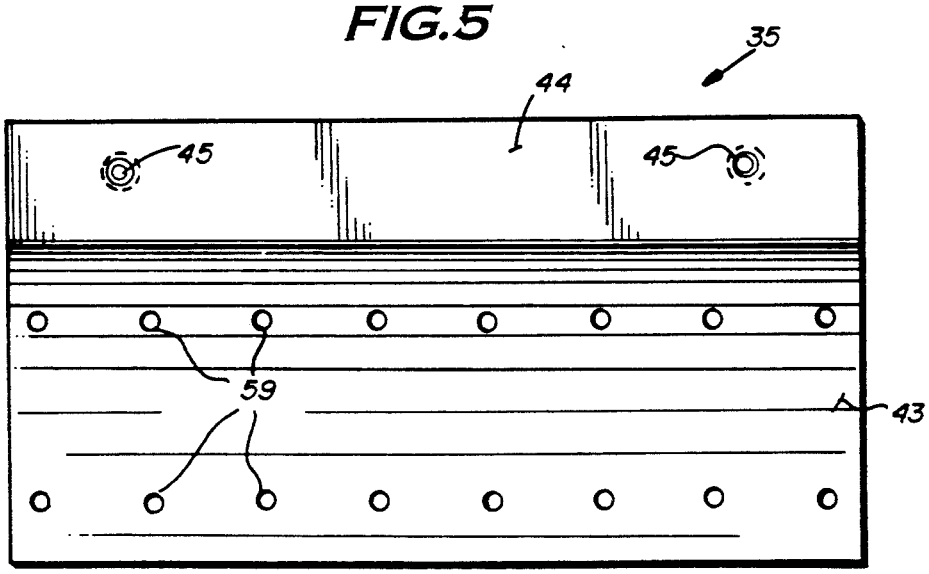

FIG. 9
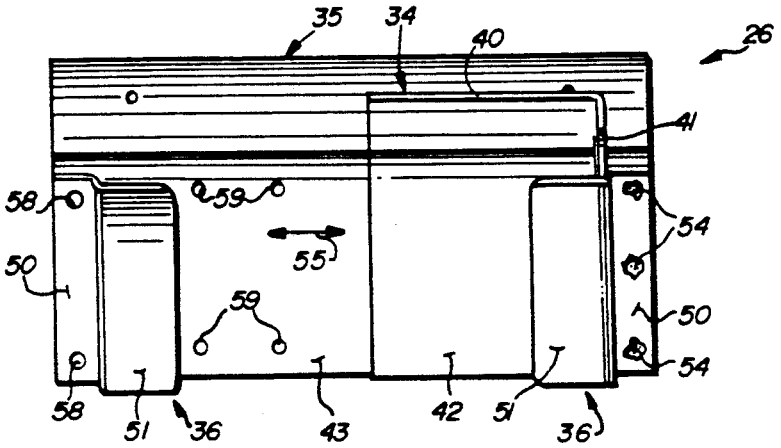
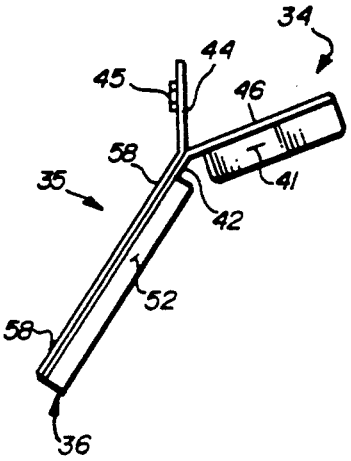
FIG. 10
FIG. 11
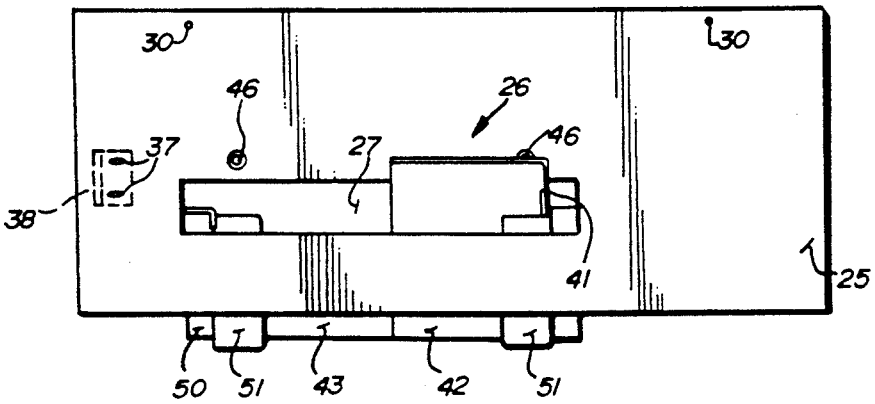

REPAIR INSERTER SEALER

BACKGROUND AND SUMMARY OF THE INVENTION

In the automatic production of business forms, there are some situations in which a form may not be properly processed due to jams, misfolds, inadvertent stoppages of the system, or the like. Also, under some circumstances a very small quantity of forms needs to be processed, an insufficient number to justify setting up all components of automated business forms handling equipment. Under these circumstances it is desirable to have a way to manually feed forms to business forms handling equipment which does not interfere with normal automatic operation of the equipment, but which is easy and safe to utilize where desired.

According to the present invention, apparatus is provided which achieves the above-mentioned goals. The apparatus according to the invention is particularly useful in association with automatic folders and automatic sealers. For example, the apparatus according to the invention is particularly suited for use with a folder sold by Moore Business Forms, Inc. of Lake Forest, Ill. under the trade designation M8152, and in association with a sealer sold by Moore Business Forms under the trade designation M4400 Speedisealer® pressure sealer. The apparatus according to the present invention is particularly desirable for use in association with the standard extended transfer conveyor associated with the M8152 folder, but can be utilized for virtually any pieces of equipment where there is a transfer conveyor between first and second different business forms handling machines. The apparatus according to the present invention is simple and easy to construct, simple to utilize in a virtually failsafe manner, and is safely interconnected to the business form handling machine components to prevent operator injury.

According to one aspect of the present invention, apparatus for handling business forms is provided including the following elements: A first machine for handling business forms. A second machine for handling business forms. A conveyor disposed between the first and second machines for conveying business forms between them. An outer movable cover for the conveyor. An inner, normally stationary, cover for the conveyor disposed beneath the outer cover. And means mounted on the inner cover providing guided manual feeding of business forms through the inner cover directly into operative association with the conveyor.

The apparatus further comprises an interlock between the inner cover and the conveyor for preventing operation of the conveyor if the inner cover is moved. The interlock preferably comprises a permanent magnetic mounted to the bottom of the inner cover, and a reed switch operatively connected to a casing for the conveyor.

The means for providing guided manual feeding preferably comprises a slot formed in the inner cover (which is preferably of transparent plastic, such as acrylic or LEXAN), and first and second guide elements extending upwardly and downwardly, respectively, from the slot. The guide elements each comprise a plate having at least one upstanding guide edge, typically the first guide element having a single guide edge, and the second guide element having first and second horizontally spaced guide edges, with the spacing between the guide edges being adjustable to accommodate business forms of different widths. The first and second guide edges may be generally S-shaped in side view, having firstand second planar portions offset by a connecting web and are connected to the second guide element plate so that the first planar portion is connected to a top surface of the plate and the second planar portion is disposed above, spaced from and substantially parallel to, the plate.

The conveyor typically includes conveyor rollers, and the second guide element plate extends from the slot downwardly at an angle of between about 30–60 degrees to the horizontal, passing over one of the conveyor rollers, and terminating adjacent another of the rollers, directing a business form supported thereby to the other conveyor roller. A substantially planar first transition portion of the first guide element typically overlaps the plate of the second guide element and is affixed to it, while a substantially planar transition portion of the second guide element is affixed to the bottom of the inner cover. The first guide element plate may make an angle of between about 130–175 degrees with respect to the second guide element plate. The conveyor casing typically has two or more locating studs extending upwardly from it which cooperate with holes provided in the inner cover to locate the inner cover with respect to the conveyor.

According to another aspect of the present invention, a cover, per se, for allowing manual feeding of business forms into operative association with a machine for acting on the business forms is provided. The cover has the following elements. A cover plate having a slot formed therein. First and second guide elements, each comprising a plate, the first guide element plate extending upwardly from the cover plate, and the second guide element plate extending downwardly from the cover plate. At least one guide edge portion associated with at least one of the first and second guide elements for guiding a business form edge through or from the slot. And means for mounting the guide elements to the cover plate at the slot. The means for mounting the guide elements to the cover plate comprise a substantially planar transition portion of the first guide element connected to the plate of the second guide element, and a substantially planar transition portion of the second guide element connected to the cover plate. The details of the guide elements, cover plate, etc. are as described above with respect to the general apparatus.

The invention also relates to a guide mechanism, per se, for guiding business forms: namely, one of the components of the cover described above. The guide mechanism comprises: A first main plate having first and second ends, and top and bottom faces. A substantially planar transition portion integral with the main plate and extending from the first end thereof, making an obtuse angle with respect to the main plate bottom face. And first and second guide elements connected to the top face of the main plate, the guide elements connected to the top face of the main plate. The guide elements each comprise first and second planar portions offset by a connecting web, the first planar portion of each connected to the top face of the main plate and the second planar portion of each spaced from and substantially parallel to the main plate top face. The guide elements spaced from each other in a dimension perpendicular to a dimension extending between the first and second ends of the main plate. The mechanism also further preferably comprises means for adjustably mounting the guide elements to the main plate so that the spacing therebetween may be adjusted to accommodate business forms of different widths.

It is a primary object of the present invention to provide an apparatus facilitating the simple manual insertion of small quantities of business forms into association with business forms handling equipment, in a simple, safe, and cost effective manner. This and other objects of the invention will become clear from an inspection of the detailed description of the invention and from the appended claims.

BRIEF DESCRIPTION OF THE DRAWINGS

FIG. 2 is a side view of the first guide element of the apparatus of FIG. 1;

FIG. 3 is a top plan view of the element of FIG. 2;

FIG. 4 is a side view of the second guide element of the apparatus of FIG. 1;

FIG. 5 is a top plan view of the element of FIG. 4;

FIG. 9 is a top plan view of the elements of FIGS. 2 through 7 assembled together;

FIG. 10 is a detail side view of the assembled elements of FIG. 9; and

FIG. 11 is a top plan view of the elements of FIGS. 8 through 10 assembled together.

DETAILED DESCRIPTION OF THE DRAWINGS

Figure 1:
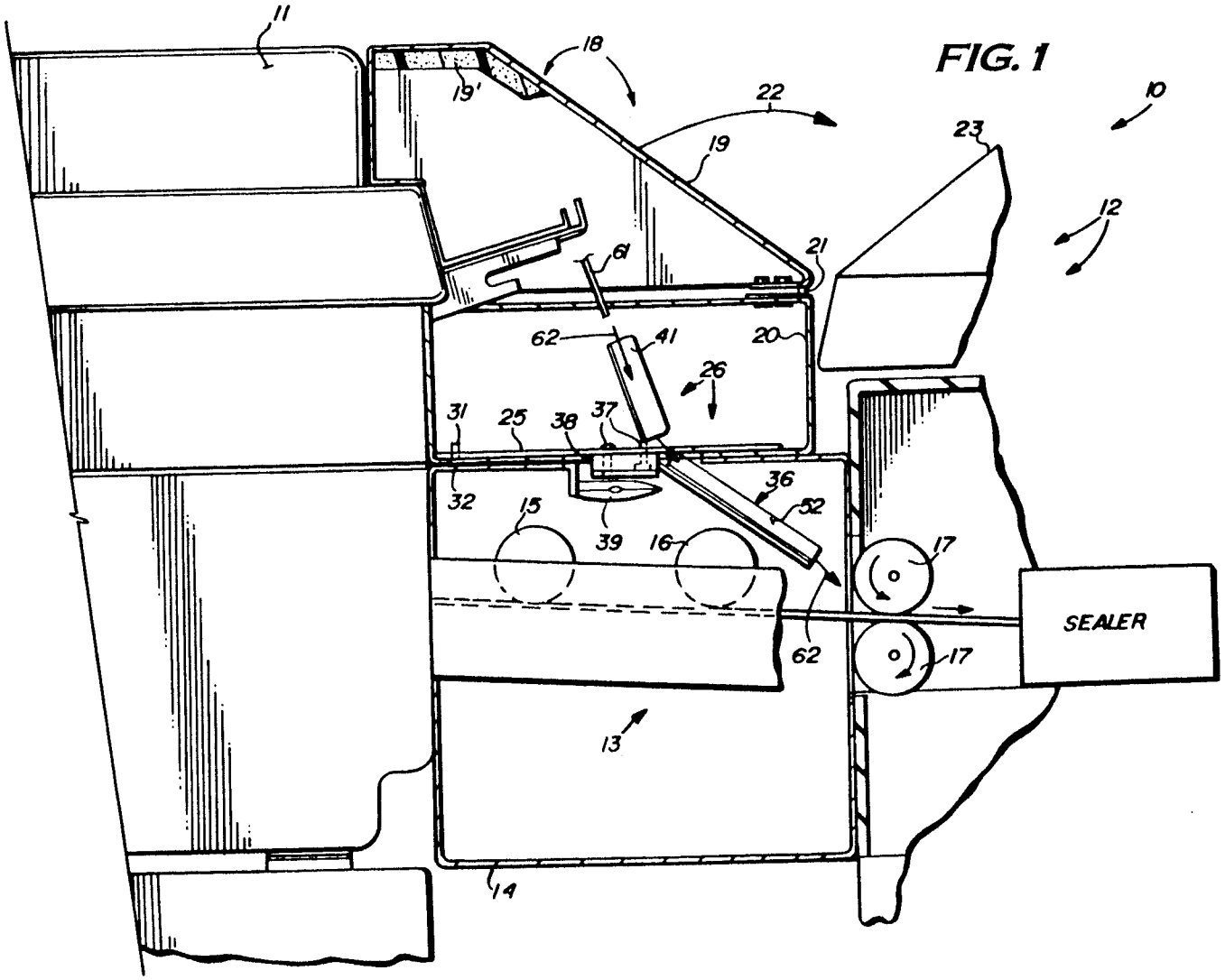
FIG. 1 is a side view, partly in cross section and partly in elevation, of an exemplary apparatus for handling business forms according to the invention.

Exemplary apparatus according to the present invention is shown generally by reference numeral 10 in FIG. 1. The apparatus comprises a first machine 11 for handling business forms, and a second machine 12 for handling business forms, with a conveyor 13 disposed between them for conveying business forms between them. While the machines 11, 12 may be of a wide variety of types, one particularly suitable example of such machines is the machine 11 being a folder (e.g. a Moore M8152 folder) and a machine 12 being a sealer (e.g. a Moore M4400 Speedisealer ® pressure sealer), with the conveyor 13, mounted in the casing 14, being a standard extended transfer conveyor which is part of the folder 11, and includes a plurality of sets of rollers 15, 16, 17, etc.

The apparatus 10 further comprises an outer cover 18, having a movable cover component 19 (which may include sound insulation 19'), and a stationary cover component 20. The component 19 is mounted for pivotal movement with respect to the component 20 about the horizontal axis hinge 21, the movable component 19 being pivotal in the direction of arrow 22 away from the stationary component 20 until it abuts the sloped surface 23 of the top of the sealer 12.

The apparatus 10 further comprises an inner cover 25, and means—shown generally by reference numeral 26 in FIGS. 1 and 9—mounted to the inner cover 25 for providing guided manual feeding of business forms through the inner cover 25 directly into operative association with the cover 13. The inner cover 25—as seen most clearly in FIGS. 8 and 11—preferably comprises a quadrate piece of transparent plastic, such as acrylic or LEXAN, and has a slot 27—defined by edges 28—formed therein for receipt of business forms, as well as openings 29, 30. The openings 29 cooperate with the guiding means 26 as will be hereinafter described, while the openings 30 cooperate with locator studs 31 (one of which is seen in FIG. 1) for properly positioning the inner cover 25 on an upper portion 32 of the casing 14 with which the studs 31 are integral. The guide means 26 include a first guide element, shown generally by reference numeral 34 best seen per se in FIGS. 2 and 3, a second guide element indicated by reference numeral 35 and best seen per se in FIGS. 4 and 5, and a pair of guide edges 36 associated with the second guide element 35 best seen per se in FIGS. 6 and 7.

A permanent magnet 38 is mounted to the bottom of the inner cover 25 by screws 37, and cooperates with a reed switch 39 which is mounted to the casing 14 (e.g. to the bottom of the casing top portion 32). The openings 33 in the inner cover 25 (see FIG. 8) are for the receipt of the fasteners 37 (see FIGS. 1 and 11) for holding the permanent magnet 38 below (to the bottom face of) the inner cover 25. The permanent magnet 38 and the reed switch 39 provide an interlock, the reed switch 39 being connected to a drive motor (not shown) for the conveyor 13. Thus, if the cover 25 is moved so that access may be gained to the conveyor 13, operation of the rollers 15 through 17 is stopped or prevented, enhancing operator safety.

The first guide element 34 comprises a plate 40 having at least one upstanding guide edge 41 therefrom; preferably a single upstanding guide edge 41 is provided. The guide element 34 also comprises a substantially planar transition portion 42 which is welded or otherwise connected to (e.g. by screw fasteners) to a plate portion 43 of the second guide element 35. The interconnection between the portions 42, 43 is best seen in FIGS. 9 and 10.

The second guide element 35, in addition to having a plate portion 43, also has a substantially planar transition portion 44, with openings 45 therein for receipt of fasteners 46 (see FIG. 11) for connecting the element 35 to the bottom face of the inner cover 25, as seen in FIGS. 1 and 11. The portions 43, 44 make an obtuse angle 47 (see FIG. 4) with respect to each other, e.g. about 135 degrees.

Figure 7:
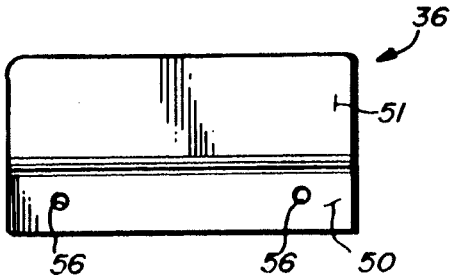
FIG. 7 is a top plan view of the guide edge of FIG. 6.
Figure 8:
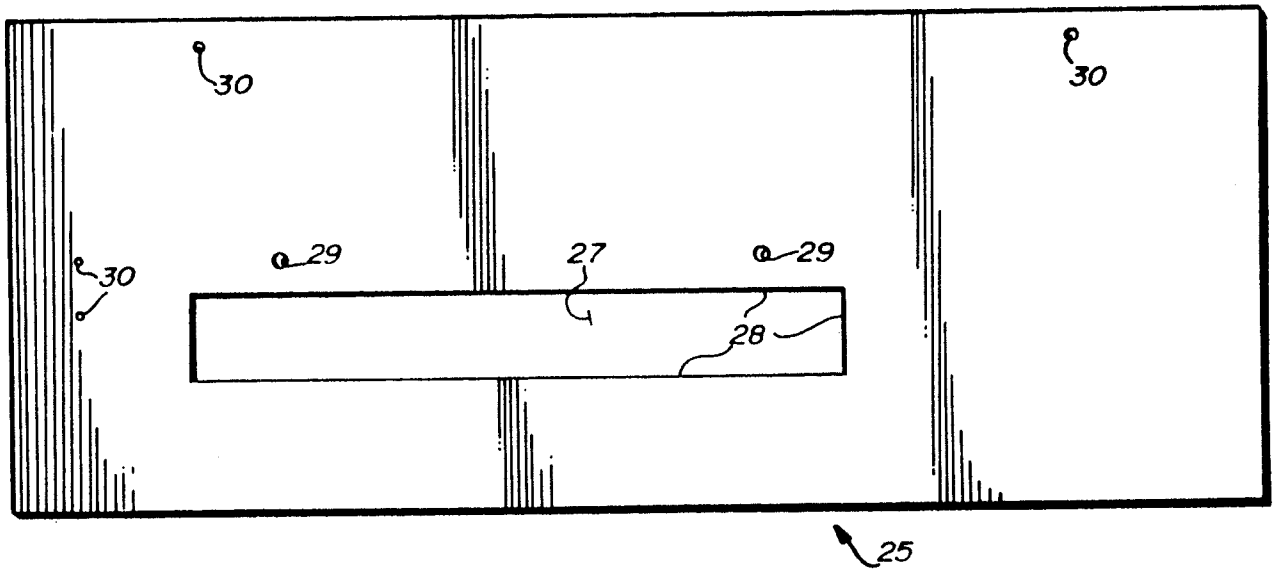
FIG. 8 is a top plan view of the inner cover plate of the apparatus of FIG. 1.
Figure 6:
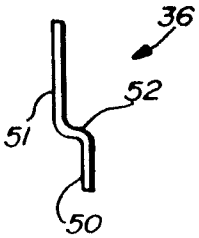
FIG. 6 is a side view of one of the guide edges associated with the second guide element of FIGS. 4 and 5.

Preferably first and second guide edges 36 are provided, spaced from each other across the width of the plate portion 43 of the second guide element 35, as seen in FIG. 9. Each of the guide elements 36, as seen most clearly in FIGS. 6, 7 and 9, is generally S-shaped in side view (FIG. 6). It has a first planar portion 50 which is connected to the plate 43, a second planar portion 51 which is spaced from the top of the plate 43 and is substantially parallel to the first planar portion 50 and the plate 43, and the planar portions 50, 51 are offset from each other by a connecting web 52. The guide edges 36 may be welded in place to the plate 43, for example, at weld points 54 for the right hand most guide edge 36 illustrated in FIG. 9. Alternatively, however, for example to allow spacing of the distance between the guide edges 36 in the dimension 55 (see FIG. 9), openings 56 may be provided in the first planar portion 50 (see FIG. 7), which receive fasteners 58 therein (see FIG. 9), passing through cooperating openings 59 formed in the plate 43 (see FIGS. 5 and 9).

FIGS. 9 and 10 show a component 26 with all of the sub-components 34 through 36 thereof assembled together, while FIG. 11 shows the components 26 mounted in association with the slot 27 of cover 25, and with the magnet 38 in place on the bottom face of the inner cover 25. The plate 43 of second guide element 35 makes an angle of between about 30° and 60° to the horizontal (see FIGS. 1 and 11), and the plates 43, 40 make an angle of between 130° and 175° with respect to each other.

Exemplary functionality of the apparatus 10 according to the present invention is as follows:

Normally the folder 11 and sealer 12 operate automatically, the folder 11 folding business forms, and those forms being transferred automatically by the rollers 15–17 of the conveyor 13 to the sealer 12 where the edges thereof are sealed (as by applying pressure to seal pressure activated cohesive). However in aberrant situations where the apparatus 10 has been shut down temporarily so that some components are partially acted upon and need to be finished, or in situations where there is merely a small quantity of forms to be acted upon that does not justify operating all of the components of the equipment, the outer movable cover component 19 is pivoted in the direction of arrow 22 until it rests upon the face 23 of the sealer 12, and then one or more business forms—indicated only schematically by 61 in FIG. 1—are fed into operative association with the rollers 17 and then the sealer 12.

Feeding of forms 61 is accomplished by guiding the left edge of each form 61 in contact with the upright side edge 41 of the first guide element 34, the business form 61 passing in the direction of the arrows 62 (see FIG. 1) under the influence of gravity, and perhaps manually pushed by the operator, so that they pass through the slot 27 in the cover 25 one at a time, and underneath the second planar portions 51 of the guide edges 36, fitting between the connecting webs 52 of the guide elements 36. The forms then continue in the direction of arrows 62, passing over the rollers 16, and guided directly into operative engagement with the rollers 17, which engage the business form 61 and move it directly to the sealer 12.

To accommodate forms of different sizes, the fasteners 58 are disconnected, the leftmost side guide 36 illustrated in FIG. 9 is moved to another, adjusted, operative position associated with openings 59 in the plate 43, and then the fasteners 58 are reconnected. Should the operator ever need to access the conveyor 13 for repairs, removal of misfed forms, or the like, he or she merely removes the inner cover 25 by lifting it up so that it detaches from the studs 31 (the openings 32 no longer receiving the studs 31). When this is done the magnet 38 mounted on the bottom of the cover 25 is operatively disconnected from the reed switch 39, opening an electrical circuit and preventing operation of the motor which drives the rollers 15 through 17 and/or other operative components of the conveyor 13.

It will thus be seen that according to the present invention a simple yet effective apparatus for manual feeding of business forms into operative association with business forms handling machines has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. Apparatus for handling business forms comprising:

a first machine for handling business forms;

a second machine for handling business forms;

a conveyor disposed between said first and second machines for conveying business forms between them;

an outer movable cover component for said conveyor;

an inner, normally stationary, cover for said conveyor disposed beneath said outer cover component; and means mounted on said inner cover providing guided manual feeding of business forms through said inner cover directly into operative association with said conveyor.

2. Apparatus as recited in claim 1 further comprising interlock means between said inner cover and said conveyor for preventing operation of said conveyor if said inner cover is moved.

3. Apparatus as recited in claim 2 wherein said conveyor has a casing, and wherein said interlock means comprises first and second operatively coupled elements, one connected to said inner cover, and the other operatively connected to said conveyor casing.

4. Apparatus as recited in claim 3 wherein said first element comprises a permanent magnet, and said second element comprises a reed switch.

5. Apparatus as recited in claim 1 wherein said means for providing guided manual feeding comprises a slot formed in said inner cover, and first and second guide elements, extending upwardly and downwardly, respectively, from said slot.

6. Apparatus as recited in claim 5 wherein each of said first and second guide elements comprises a plate having at least one upstanding guide edge mounted thereon.

7. Apparatus as recited in claim 6 wherein said second guide element has first and second horizontally spaced upstanding guide edges mounted thereon.

8. Apparatus as recited in claim 7 wherein the horizontal spacing between said first and second guide edges of said second guide element is adjustable to accommodate business forms of different widths.

9. Apparatus as recited in claim 6 wherein said conveyor includes conveyor rollers, and wherein said second guide element plate extends from said slot downwardly at an angle of between about 30 and 60 degrees to the horizontal, passing over one of said conveyor rollers, and terminating adjacent another of said conveyor rollers, directing a business form supported thereby to said another of said conveyor rollers.

10. Apparatus as recited in claim 9 wherein said first guide element plate makes an angle of between about 130 and 175 degrees with respect to said second guide element plate.

11. Apparatus as recited in claim 7 wherein said first and second guide edges are generally S-shaped in side view, having first and second planar portions offset by a connecting web, and are connected to said second guide element plate so that said first planar portion is connected to a top surface of said plate, and said second planar portion is disposed above, spaced from and substantially parallel to, said plate.

12. Apparatus as recited in claim 6 wherein said first guide element has a substantially planar transition portion which overlaps said plate of said second guide element, being affixed thereto; and wherein said second guide element has a substantially planar transition portion affixed to said inner cover.

13. Apparatus as recited in claim 12 wherein said conveyor has a casing, and wherein said inner cover has a magnet connected to a bottom face thereof, which cooperates with a reed switch operatively connected to said conveyor casing to provide an interlock so that if said inner cover is moved, operation of said conveyor is prevented.

14. Apparatus as recited in claim 1 wherein said inner cover is of transparent plastic.

15. Apparatus as recited in claim 5 wherein said conveyor has a casing with a substantially horizontal top surface, said inner cover mounted to said top surface by a plurality of locating studs and cooperating holes, provided in and with said inner cover and said top surface.

16. Apparatus as recited in claim 5 wherein said first machine comprises a folder, and said second machine comprises a sealer, and wherein said outer movable cover component is mounted for pivotal movement about a horizontal axis.

17. A cover for allowing manual feeding of business forms into operative association with a machine for acting on the business forms, comprising:

a cover plate having a slot formed therein;

first and second guide elements, each comprising a plate, said first guide element plate extending upwardly from said cover plate, and said second guide element plate extending downwardly from said cover plate;

at least one guide edge portion associated with at least one of said first and second guide elements for guiding a business form edge through or from said slot; and means for mounting said guide elements to said cover plate at said slot.

18. A cover as recited in claim 17 wherein said means for mounting said guide elements to said cover plate comprise a substantially planar transition portion of said first guide element connected to said plate of said second guide element, and a substantially planar transition portion of said second guide element connected to said cover plate.

19. A cover as recited in claim 17 wherein said second guide element plate makes an angle of between about 30 and 60 degrees with respect to said cover plate.

20. A cover as recited in claim 19, wherein said first and second guide element plates make an angle, at said slot, with respect to each other of between about 130 and 175 degrees.

21. A cover as recited in claim 19 wherein said second guide element has first and second horizontally spaced upstanding guide edges mounted therein.

22. A cover as recited in claim 21 wherein said first and second guide edges are generally S-shaped in side view, having first and second planar portions offset by a connecting web, and are connected to said second guide element plate so that said first planar portion is connected to a top surface of said plate, and said second planar portion is disposed above, spaced from and substantially parallel to, said plate.

23. A cover as recited in claim 21 wherein the horizontal spacing between said first and second guide edges of said second guide element is adjustable to accommodate business forms of different widths.

24. A cover as recited in claim 20 further comprising a permanent magnet mounted to said cover plate.

25. A cover as recited in claim 17 wherein said cover plate is of transparent plastic.

* * * * *